US005593618A

United States Patent [19]

Okoniewski et al.

[11] Patent Number: 5,593,618

[45] **Date of Patent: *Jan. 14, 1997**

[54] CONDUCTIVE FIBERS

[75] Inventors: Marian K. Okoniewski; Jerzy S. Szadowski; Piotr J. Bajda; Jerzy Z. Kobus; Joanna Koprowska; Barbara E. Ratajczyk, all of Lodz, Poland

[73] Assignee: Instytut Wlokiennictwa, Lodz, Poland

[21] Appl. No.: 399,457

[22] Filed: Mar. 7, 1995

Related U.S. Application Data

[62] Division of Ser. No. 39,129, filed as PCT/GB91/01743, Oct. 8, 1991, Pat. No. 5,431,856.

[30] Foreign Application Priority Data

| | | | |
|---|---|---|---|
| Oct. 9, 1990 | [PL] | Poland | 287267 |
| Mar. 28, 1991 | [GB] | United Kingdom | 9106709 |
| Oct. 1, 1991 | [GB] | United Kingdom | 9120836 |

[51] Int. Cl.[6] ..... H01B 1/00; H01B 1/02; H01B 1/08; H01B 1/10

[52] U.S. Cl. ..... 252/512; 252/514; 252/518; 8/115.56; 8/624; 428/76; 428/375; 427/126.1; 427/419.1

[58] Field of Search ..... 252/512, 514, 252/518, 500; 8/115.56, 115.65, 532, 624; 428/936, 76, 375; 427/126.1, 419.1, 419.8

[56] References Cited

U.S. PATENT DOCUMENTS

| | | | |
|---|---|---|---|
| 3,014,818 | 12/1961 | Campbell | 117/227 |
| 4,122,143 | 10/1978 | Momotari et al. | 264/104 |
| 4,336,028 | 6/1982 | Tomibe et al. | 8/624 |
| 4,364,739 | 12/1982 | Tomibe et al. | 8/654 |
| 4,378,226 | 3/1983 | Tomibe et al. | 8/491 |
| 4,744,860 | 5/1988 | Cop et al. | 8/115.65 |
| 4,876,032 | 10/1989 | Liepins et al. | 252/500 |
| 5,154,727 | 10/1992 | Dyer | 8/115.65 |

FOREIGN PATENT DOCUMENTS

| | | |
|---|---|---|
| 0086072 | 1/1983 | European Pat. Off. . |
| 0217987 | 4/1987 | European Pat. Off. . |
| 110244 | 5/1979 | Poland . |
| 0035406 | 9/1981 | WIPO . |

*Primary Examiner*—Douglas J. McGinty
*Assistant Examiner*—M. Kopec
*Attorney, Agent, or Firm*—Woodcock Washburn Kurtz Mackiewicz & Norris

[57] ABSTRACT

The present invention relates to a method for increasing the electrical conductivity of a polymeric substrate material, characterized by treating said material with an intermediate composition having an affinity for the material, said intermediate composition containing a grouping capable of forming a complex or otherwise reacting with a transition metal ion, forming such complex or reaction product with said transition metal ion, and combining said metal ion with an anion moiety thereby increasing the conductivity of said material.

3 Claims, No Drawings

CONDUCTIVE FIBERS

This is a division of application Ser. No. 08/039,129, filed as PCT/GB91/01743, Oct. 8, 1991, now U.S. Pat. No. 5,431,856.

DESCRIPTION

This invention relates to conductive materials and has particular reference to imparting conductivity in materials such as natural or synthetic polymers for a variety of commercial, industrial uses. Such materials are used in many industrial processes in which a degree of conductivity is both necessary and desirable. For example in the paper making industry, the high speeds of modern paper making machines, particularly in the drying sections, can result in considerable induced electrostatic build up. There is a need, therefore, to provide fibre and layer components having a degree of conductivity which enable dissipation of the charge so generated.

In a similiar manner, in plastic fuel lines where there is a fast flow of fuel, for example, as in aircraft, the build-up of static in such lines can result in static discharge to earth and the formation of pin-holes in the fuel line with a consequence of leakage therefrom. Hitherto, fuel lines have been rendered conductive by forming in a surface of the fuel line a longitudinal strip of carbon filled polytetrafluoroethylene which provides a conductive path. While reasonably successful, the joint between such a filled conductive strip and the remainder of the substrate layer constituting the fuel line is a line of weakness. The continued passage of fuel at high speed through the line can result in rupture and/or erosion of the conductive strip, particularly at a bend, with a result that a discontinuity forms with attendant charge build up in the area of the discontinuity followed by pin-holing and subsequent leakage.

There is, therefore, a need in industry to provide polymeric structures which have a uniformity of conductivity and conductive properties.

Numerous methods for imparting electrical conductivity to polymeric substrates in general, and to synthetic polymeric fibres in particular, are known in the art. For example, one method for imparting electrical conductivity to polymeric fibres involves plating the surface of a fibre. This method requires etching of the surface of the fibre prior to plating in order to obtain satisfactory adhesion. The process involves sensitizing and activating the fibre prior to plating; as a result the properties of such electrically conducting fibre differ greatly from those of the starting fibre in, inter alia, softness, flexibility and smoothness.

In another prior art process, metal particles are kneaded into a polymer which is then spun into a yarn. This process suffers from the disadvantage that the metal particles tend to clog the nozzle during spinning. In addition, unless the metal content of the fibres is kept relatively low the electrically conducting fibre obtained by this method has inferior mechanical properties compared with the fibres of the same material not containing metal particles.

In a further process of the prior art, metal powder has been deposited in pores of a polymeric fibre; this requires an extraordinarily porous fibre and intricate process steps.

In U.S. Pat. Nos. 3,014,818 and 4,122,143, electrically conductive products are produced by reducing a copper compound to metallic copper. In U.S. Pat. No. 3,014,818 an electrically conductive fibrous material is produced by soaking the fibres such as cotton or acrylic fibres in a bath comprising a reducible salt of nickel, copper, cobalt or iron and the fibre is then subjected to a reducing treatment to obtain free metal particles which are dispersed through the interior of the fibre. Sodium borohydride and hydroxylamine are disclosed as satisfactory reducing agents. U.S. Pat. No. 4,122,143 discloses the use of cured products which may be obtained by reducing copper simultaneously with the curing of a resin. The disadvantage of this process is that it is not possible to use it to impart electrical conductivity to an existing fibre.

In each of the above referred to specific processes, the electrical conductivity is obtained by the presence of metallic copper in the polymeric material. Many polymeric materials have a strong affinity for monovalent copper ions and this results from coordinative bonding between cyano groups within the fibre or material and monovalent copper ions. The absorption of monovalent copper ions into materials such as, for example, arylic or modacrylic fibres, turns the fibres to a yellowish colour and in many cases the bonding is such that in spite of the adsorption of a considerable amount of copper, very little increase in electrical conductivity results.

U.S. Pat. No. 4,364,739 describes and claims a method for making an electrically conducting fibre which comprises subjecting acrylic and modacrylic fibres to a first heat treatment in a bath containing a copper compound and a reducing agent to adsorb monovalent copper ions within the fibre and then subjecting the fibre to a second heat treatment in the presence of a sulfur containing compound to convert said adsorbed monovalent copper ions to cuprous copper sulfide.

This method has the advantage that a considerable increase in electrical conductivity results from the treatment and the fibres forming the subject of U.S. Pat. No. 4,364,739 can be washed repeatedly without a substantial reduction in the electrical conductivity.

European Patent Specification No. 0086072 also relates to an electrically conducting material including a cyanic group containing material having adsorbed thereby sulphides of copper and an auxiliary metal selected from silver, gold and elements of the platinum group. The cyanic group containing material may be in the form of a powder or a shaped body such as a fibre, film, plate, rod or the like and is formed of a synthetic polymer such as a polyacrylonitrile or a polyamide having introduced therein cyanic groups; a naturally occurring polymeric substance such as cotton having introduced therein cyanic groups or a low molecular compound such as phthalonitrile. The electrically conducting material may be prepared by treating the cyanic group containing material with (a) a source of monovalent copper ions, (b) a source of ions containing the auxiliary metal and (c) a sulphur containing compound to form sulphides of copper and auxiliary metal adsorbed by the cyanic group containing material.

In addition to the foregoing, European Patent Specification No. 0035406 and U.S. Pat. No. 4,378,226 are concerned to produce polymeric conductive material containing copper sulphide due to the cuprous ion having a strong affinity to cyanic groups, which cyano groups are either inherent in the polymeric material themselves or whereby the polymeric material is modified to include the cyanic groups as part of its polymeric structure.

According to Polish Patent Specification No. 110244, the electrical conductivity can be imparted to polymeric fibrous material not containing the cyanic groups by the graft copolymerisation of vinyl monomers which contain such groups in their structure.

From all the foregoing, the use of copper reduced to copper sulphide in combination with cyano groups within the polymeric material itself or alternatively to modify the polymeric material to incoporate such cyanic groups is well known.

There is no disclosure in any of the prior art known to the present applicant of a method of imparting electrical conductivity to materials not containing cyano groups such, for example, as polyolefins, polyvinyls such as polystyrene, polyester such as polyethylene terephthalate and polyethers such as poly(2,6 dimethyl phenylene oxide) and poly carbonate.

Furthermore, where mixtures of materials are employed such as any of the foregoing with acrylics, modacrylics, acrylonitrile polyamides, the use of prior art processes results in patchy conductivity without any degree of uniformity.

The present invention seeks to overcome these problems and to provide a method of rendering a polymeric material conductive and providing a degree of control over the conductivity imparted thereto.

According to the present invention, there is provided a method for increasing the electrical conductivity of a polymeric substrate material, characterised by treating said material with an intermediate composition having an affinity for the material, said intermediate composition containing a grouping capable of forming a complex or otherwise reacting with a transition metal element ion, forming such complex or reaction product with said transition metal ion, and combining said metal ion with an anion moiety thereby increasing the conductivity of said material.

Typical anion moieties are sulphide ions and iodide ions although any such anion moieties used in the art may be employed.

The intermediate composition in accordance with the present invention serves as a bridge between the polymeric material an the one hand and the transition element metal imparting conductivity on the other.

In one aspect of the invention, the intermediate composition is a dye, or is based on a dye, for the polymeric material.

The advantage of such an arrangement is that the man skilled in the art of dyeing can apply the present invention and impart conductivity to a polymeric material such as a fibre, using on his existing knowledge of dyestuffs. The intermediate composition may be physically bonded to the polymeric material substrate or otherwise attached thereto.

In another aspect of the present invention the intermediate composition may be a cationic composition. Where a cationic intermediate composition is contemplated, at least the surface portion of the polymeric substrate material can be prepared to improve and enhance the the affinity thereof by rendering said surface portion anionic. The anionicity of the surface of the polymeric substrate can be improved, enhanced or applied by physico-chemical means or by chemical treatment. The intermediate composition in accordance with the present invention does not necessarily have to be a dyestuff, since it merely has to have an affinity for the polymeric substrate surface; it has been found that dyestuffs are particularly useful in the practice of the present invention.

The said grouping may be capable of forming a coordination complex or chelate complex with the transition metal concerned. The transition element metal is preferably a coinage metal and typically may be copper or silver.

The grouping capable of forming complexes may be a cyano-grouping and the composition may be a dyestuff matched to the properties of the material with which it is to be employed. The material to be rendered conductive may be any one or more of polyolefins, polyvinyls, polyamides, polyesters, polyethers, polycarbonates, acetates and triacetates, polyaramid, polyimid, cellulose or keratin. In the case of, for example, the material being a polyamide, the composition may be an acid dye; where the material is a cellulose, the composition may be a direct and/or a reactive dye. Where the material is polyester, acetate, or triacetate, the composition may be a dispersed dye. In particular embodiments of the present invention the composition may be an azo dye, an oxazine dye, a styryl dye and an anthraquinone dye.

In a further aspect of the present invention the polymeric substrate material may be modified to enhance the affinity of an intermediate composition therefor in accordance with the present invention. Where a cationic intermediate composition is employed, it is helpful if at least the surface portion of the polymeric substrate material can be rendered partially or substantially anionic. This can be achieved either by a physico chemical treatment such, for example, by the treatment of a polymeric material surface using low temperature plasma preferably in an oxidising atmosphere or by chemical methods. In a specific embodiment of the present invention where the substrate material is polyethylene teraphthalate fibre, then this material can be treated at an elevated temperature with a solution of sodium hydroxide or concentrated sulfuric acid in order to enhance the anionicity of the substrate surface. In a further aspect of the present invention a polyamide fibre may be treated with a substance such an benzosulphanide for the same purpose.

It will be appreciated also that the intermediate composition may be anionic in which case cationic sites would be needed in the surface of the polymeric material.

Such methods are well known to the man skilled in the art.

In a further aspect of the present invention, the substrate surface may be subjected to graft polymerisation using, for example vinyl monomers containing anionic groupings. The electrically conductive material in accordance with the present invention may be in the form of plates, substrates, sheets, foams, fibres, powders and yarns.

When in the form of fibres, the polymeric material produced in accordance with the invention may be utilized as clothes, carpets, interior decoration sheets, gloves and the like in combination with other fibres, in order to reduce a tendency for the material to acquire and retain a static charge. When in a form of a film or plate, the electrical conductivity of the materials of the invention allow use as covers and enclosures for electrical parts such as integrated circuits, and for the protection of integrated circuits which are required to be shielded from electrostatic charges during storage or transportation.

Powder produced in accordance with the present invention may be incorporated into coating compositions to form electrically conductive coatings and because of the excellent thermal stability of the conductive material, such materials may be used readily to form moulded articles having conductive properties.

The material in accordance with the present invention may also be applied to a structure which is a woven or non-woven structure, a batting or random web, or a structure in which the fibres are at least in part, bonded at their fibre to fibre contact point, thus providing a stiffened fibre structure.

Dyes containing cyano groups that may be used in accordance with the present invention have a general formula:

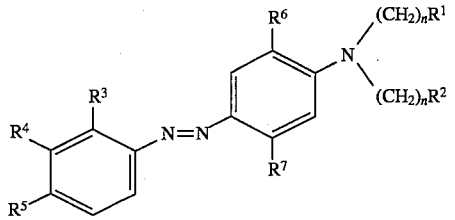

in which n is 1 to 8, $R^1$, $R^2$=H, OH, OAc, CN, Ph in which $R^1$ and $R^2$ may be the the same or different;

$R^3$, $R^4$ and $R^5$ may each be H, Alk, OAlk, Cl, Br, $NO_2$, CN, $SO_3H$, COOH; where $R^3$, $R^4$ and $R^5$ may be each the same or different;

$R^6$ and $R^7$ are H, Alk, OAlk, NHAc and in which $R^6$ and $R^7$ are different.

In the foregoing, Alk may have the general formula $C_nH_{2n-1}$; Ac may be COAlk, COPh and in which Ph is

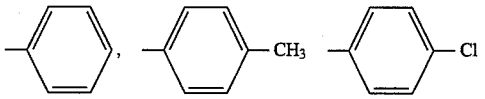

In another aspect of the present invention, the dyestuff may have the general formula

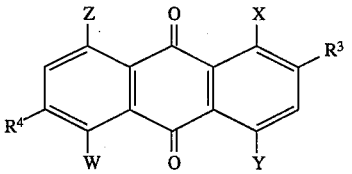

in which X, Y, Z and W have the general formula

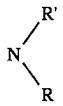

or OH and in which X, Y, Z and W may be the same or different and R, R' may be H, $(CH_2)$, $R^1$, $(CH_2)_nR^2$, or Ph in which R and R' may be the same or different and in which n, $R^1$ and $R^2$ are as set out above and $R^3$ and $R^4$ may be H, CONRR', CN, COOR, COOH, $SO_3H$, $SO_2NRR'$ in which $R^2$ and $R^3$ are the same or different.

In a further aspect of the present invention the dyestuff may have a general formula:

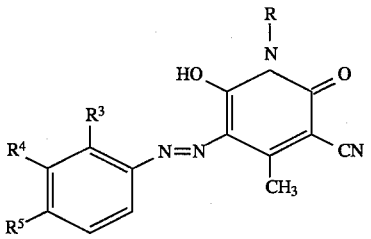

in which R is H, Alk, $(CH_2)_nOH$ and in which $R^3$, $R^4$ and $R^5$ are as defined above.

In another aspect of the present invention the composition may be a dyestuff having the general formula:

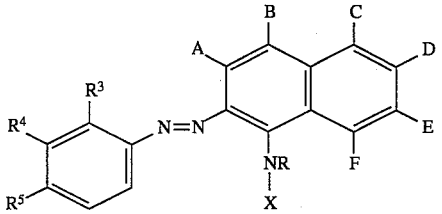

in which A, B, C, D, E and F may be H, OH, $SO_3H$ and in which X is a residue of chlorotriazine or of another reactive system.

In yet another aspect of the present invention, the composition may have the general formula

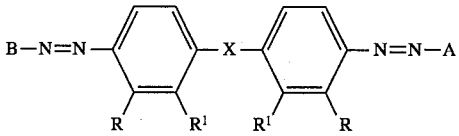

in which X=—N=N, —CH=CH—, —HNCONH—, —CONH—, and A is

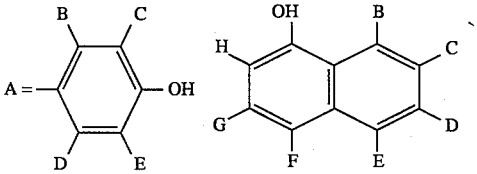

and B is

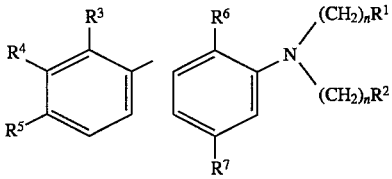

in which B, C, D, E, F, G, and H may be —H, —$SO_3H$, —COOH, —$NH_2$ and in which $R^1$ to $R^7$ are as in formula 1 above and in which R' and R may be —H or —$SO_3H$.

The foregoing are mainly azo, dioxazine, anthroquinone or styryl dyes which show the capacity of coordinative bonding of copper sulphides and of mixtures of copper sulphide with silver sulphides.

Where the intermediate composition is a cationic composition such a composition may be selected from methine, di- and triaryl methine, heteroatom-bridged di- and triaryl methine, azo and anthraquinone dyes, azo analogues of diaryl methine dyes (nomenclature according to H. Zollinger, Colour Chemistry, VCH Verlangsgesellschaft mbH, 1987). Non dyestuffs are cationic-optical brightening agents such as those mentioned in Rev. Prog. Coloration Vo. 17, 1987, pp 39–55 and in Color Index, and generally colourless agents resembling cationic dyestuffs as regards their affinity to fibres or other material with anionic groups, but lacking the conjugated double bonds acting as colour-forming groups in dyestuffs.

In a preferred embodiment of the present invention, the substrate material may be dyed by using established and well known dyeing techniques using an amount of absorbed dye material within the range of 0.2 to 7% of the weight of the substrate material.

After introduction of the selective intermediate composition or dye into the material, the transition metal ions such as copper may be deposited in the material preferably by any of the known methods such, for example, by reduction of a copper salt using a sulphur containing compound. In addition to coinage metals, transition metals within the platinium groups such as ruthenium, rhodium, palladium, osmium, iradium and platinum may also be deposited. As a source of copper, a combination of bivalent copper compound such as a salt or a complex of bivalent copper, and a reducing agent capable of convening bivalent copper compound into monovalent copper ions is generally employed. The bivalent copper salts may be copper sulphate, copper chloride, copper nitrate and cuptic acetate. Examples of reducing agents include metallic copper, hydroxylamine or its salts, ferrous sulphate, ammonium vanadate, furrural, sodium hypophosphite, sodium thiosulphate and glucose. Cuprous salts or complexes may also be used as monovalent copper ions.

The sulphur containing compound may be selected from sodium sulphide, sodium dioxide, sodium hydrogen sulphite, sodium pyrosulphite, sulphurous acid, dithionous acid, sodium dithionite, sodium thiosulphate, thiourea dioxide, hydrogen sulphide, sodium formaldehyde sulphoxylate, zinc formaldehyde sulphoxylate and mixtures thereof. Since these sulphur containing compounds have a reducing activity they may also be used at least in part as the reducing agent for convening bivalent copper ions into monovalent copper ions. Other transition metals may be incorporated as described by using a salt or complex of auxiliary metal such, for example, as a sulphate, nitrate, chloride, acetate, benzoate or a thiocyanate complex.

The sulphur containing compounds may, in one aspect of the invention, be donors of sulphur ions as the anion moiety to form sulphides with the metal ions complexed or otherwise reacted with the intermediate composition.

In a typical aspect of the present invention, the composition for treating the substrate prior to the formation of the transitional metal complex is by any known method of treating with dyes and typically in an amount of 0.1 to 7% of the matrix mass.

Materials with electrical conductivity in accordance with the present invention may contain as an effective conducting element, copper and silver sulphides and mixtures thereof together with other trace elements in the manner indicated, these materials being coordination bonded with the composition applied to the substrate. In a particular aspect of the present invention fibres treated by the method of the invention can show an resistivity of less than $10^2\Omega$cm resistivity and maintain their electro-conductivity after repeated washing.

In essence, therefore, the invention provides means of attaching transition metal ions to polymeric materials through the intermediary of an intermediate composition which latter has an affinity for the polymeric material and which is capable of forming a complex with the ions concerned. It will be appreciated by the man skilled in the art that the amount of conductivity imparted to any given polymeric material is dependant on the amount of the intermediate composition applied thereto and to the nature of that intermediate composition. Furthermore, the method of the invention permits a more uniform degree of conductivity to be imparted to the polymeric material, particularly where the material is a mixture or a blend, than hitherto.

The invention also includes electrically conductive materials when produced by the process of the present invention.

Following is a description by way of example only of methods of carrying the invention into effect.

EXAMPLE 1

Polyester fibres of size of 3 dtex and commercially available under the trade name "ELANA" are subjected to a dyeing process by immersion in a treatment bath having a bath-to-fibre ratio of 10:1 at a temperature of 130° C. for a period of 2 hours. The bath contained 5% on the weight of the fibres of a dispersion dye being formed by the coupling of diazotized.

2-cyano-4-nitro-6-bromoaniline with N,N-di-δ-cyanopropyloaniline. The resultant dye had a deep red colour which was imparted to the fibres.

After the treatment, the fibres were rinsed and were then treated at a temperature of 40° C. for a period of 20 minutes with a bath containing 10% based on the weight of the fibre mass of copper sulphate hydrate ($CuSO_4.5H_2O$) and 12% based on the weight of the fibre mass of sodium-thiosulphate while maintaining the bath to fibre ratio of 10:1. After one hour the temperature was increased to a 130° C. and was maintained at this temperature for another 50 minutes.

At the conclusion of this latter treatment the fibres were removed from the bath and then intensively washed at a temperature of 60° C. in the presence of 1 g/l of nonionic washing agent commercially available under the Trade Name "ROKAFENOL N-8".

The fibres so treated exhibited electrical conductivity and had a deep-red colour with an orange tint. On testing the fibre had a specific electrical resistance of less than $10^2\Omega$cm and the level of electrical conductivity was resistant to repeated washing in a water bath containing nonionic washing agent as well as to washing in organic solvents, such, for example, as Per.

Comparison of the physical properties of the fibres so treated with untreated fibre showed that there was no significant change in the various physical properties and strength indices. A sample of the nonmodified fibre was subjected to the same treatment with copper sulphate and sodium thiosulphate in the manner indicated above, but without the initial dyeing step provided for in accordance with the present invention. After strenuous washing, the electrical specific resistance of this control sample had risen to greater than $10^{12}$ $\Omega$cm.

EXAMPLE 2

Polyamide fibres having a fibre size of 17 dtex and commercially available under the trade mark "POLANA" was subjected to dyeing by a discontinuous method by immersion in a bath having a bath to fibre ratio of 10:1 at a temperature of 110° C. The bath contained 1% on the mass of the fibres of an acid dye of 1-N-ethylo, N-β-cyanoethyloamino-4-fenylaminoanthraquinone-2-sulphonic acid. The fibres were maintained in the bath for a period of 2 hours and at the conclusion of the dyeing period the fibres were removed from the bath and were rinsed thoroughly. The fibres were observed to be dyed blue.

The dyed fibre was then treated as described in Example 1 with a solution of copper sulphate and sodium thiosulphate, initially at a temperature of 40° C. for a period of 20 minutes. The temperature of the treatment bath was thereafter raised steadily over a period of one hour to a temperature of 100° C. and then maintained at this temperature for a further period of one hour.

At the conclusion of this treatment, the fibre was removed from the treatment bath and was subjected to strenuous washing at a temperature of 60° C. in the presence of a nonionic washing agent commercially available under the trade name "ROKAFENOL N-8" present at a concentration of 1 g/l. After washing, the modified fibre had an olive colour and an electrical resistivity well below $10^2\Omega$cm. After repeated washing the specific electrical resistance was still maintained below $10^2\Omega$cm. It was observed that there had not been any significant degradation of the mechanical properties of the fibre.

EXAMPLE 3

Viscose fibres of size 1.7 dtex were dyed at a temperature of 40° C. in a bath having a fibre-to-bath ratio of 20:1 and containing 4% based on the weight of fibres of a reactive dye being the produce of coupling diazo-tizated 2-cyanoaniline with an H acid and acylated with cyanuric acid. After 10 minutes of treatment with the solution of the dye, a proportion of 10 g/l of sodium chloride was added in the form of domestic salt over a period of 20 minutes and then over a further 10 minute period, 10 g/l of calcinated salt was added; the bath being maintained an a temperature of 40° C. for a further 60 minute period.

After this treatment, fibres were removed and washed intensively to remove the dye not bonded with the fibre and the fibre was then subjected to the treatment with copper sulphate and sodium thiosulphate as described in Example 2 above.

At the conclusion of this treatment, the specific electric resistance was measured and found to be below $10^2\Omega$cm. After the dyeing the fibre was coloured red, whereas after the modifying treatment the fibre assumes an olive colour with a red tint. Repeated washing did not result in any significant reduction in the electrical properties.

EXAMPLE 4

A polyester fibre commercially available under the trade name ELANA and having a fibre size of 3 dtex is subjected to graft copolymerisation in a treatment bath containing:

30 g/dm$^3$ of acrylic acid 5 g/dm$^3$ of biphenyl 1 g/dm$^3$ of dibenzoyl peroxide 30 g/dm$^3$ of sodium chloride.

A bath to fibre ratio of 10:1 was maintained at a temperature of 100° C. for a period of 120 minutes. After the graft copolymerisation step the fibre is treated with hot water in order to remove homopolymers and unreacted products, and then it is subjected to a dyeing process in a bath containing 5% on the weight of the fibre of a cationic methine dye (presented in Color Index under the trade name C.I. Basic Yellow 21); The dye bath is maintained at the temperature of 90° C. and the dyeing process continued for a period of 60 minutes, at a bath to fibre ratio 10:1 and ph of about 4. The resultant dyed fibre has a yellow colour. After dyeing the fibre is then rinsed and then further treated at a temperature of 40° C. for a period of 20 minutes with a bath containing 10% based on the weight of the fibre mass of copper sulphate and 12% based on the weight of the fibre mass of sodium thiosulphate while maintaining the bath to fibre ratio of 10:1. After one hour the temperature is increased to 100° C. and is maintained at this level for a further 50 minutes. At the end of this period, the fibre is removed from the reaction bath and is thoroughly rinsed and intensively washed at a temperature of 60° C. in the presence of 1 gm/dm$^3$ of nonionic washing agent ROKAFENOL N-8. At the conclusion of this process an electroconductive fibre of olive colour is obtained. The fibre is characterised by electrical specific resistance below $10^2\Omega$cm. The electroconductive effect is maintained in spite of repeated washing in a water bath containing nonionic agent as well as to washing in organic detergents such as Per.

EXAMPLE 5

A fabric woven from polyester yarn commercially available under the trade name TORLEN of 167 dtex is subjected to the treatment with low-temperature plasma generated in air at the pressure of 2 hPa for a period of 30 seconds, between two parallel metal electrodes with 10 mm spacing one of which is coated with a dielectric such as glass.

The plasma is generated at a current supply frequency of 27,12 MHz. After the plasma treatement the woven fabric is subjected to dyeing process in a bath containing 1% of azo-cationic dye which is a derivative of triazole (presented in Color Index under the trade name C.I. Basic Red 22).

The parameters of dyeing process and of further procedure are as set out in Example 4. After the treatment with copper sulphate thiosulphate the woven fabric has an olive colour with a red tint and exhibits an electrical surface resistance of about $10^3\Omega$.

EXAMPLE 6

Polyamide fibres commercially available under the trade name POLANA and having a fibre size of 17 dtex are subjected to dyeing in a bath containing 2% on the mass of fibres of triphenyl methine dye (presented in Color Index under the trade name C.I. Basic Violet 3) at a bath to fibre ratio of 10:1, at a temperature of 100° C. for a period of two hours. At the conclusion of the dyeing the fibres acquired violet colour. After thorough rinsing the dyed fibre is treated (as it is described in the first example) with a bath containing copper sulphate and sodium thiosulphate. After this process fibre of olive colour with violet tint is obtained; it exhibits specific electrical resistance below $10^2\Omega$cm.

EXAMPLE 7

A mercerized cotton fabric is padded to 80% pickup with a liquor containing 5% trimethylol acetylenediureine, 6% choline chloride 22,2,2, 2% $MgCl_2 \times 6\ H_2O$, 0,1% nonionic wetting agent and remainder water with the pH adjusted to pH of 4 with hydrochloric acid. After padding, the fabric is dried for four minutes at 90° C., cured for four minutes at 160° C., after washed in deionized water and dried again. Because of the positive charge imparted to the fabric by the attached cationic groups, the fabric is dyed with anionic dye; the following dyeing procedure being used:

Liquor to fabric ratio: 20:1

Dyeing temperature: 100° C.

Time of the dyeing: 1 hour

Dye amount: 2% on the weight of the good.

The anionic dye used is 1-N-ethylo-N-cyanothyloamine-4 fenyloamine anthraquinone-2-sulfonic acid. The pH of the bath is adjusted to 4. After thorough rinsing, the dyed fabric is treated in a bath which is a water solution containing 10% (owg) of cupric sulfate and 14% (owg) of sodium thiosulfate at liquor to fabric ratio of 20:1. The bath is gradually heated up to 90° C. starting from ambient temperature and kept at this temperature for 90 minutes. The so treated cotton fabric is then rinsed well in cold water and dried up to equilibrium moisture content. The olive coloured cotton fabric thus obtained exhibited an electrical resistivity in order of 45 Ohm×cm.

We claim:

1. A polymeric substrate material having an increased level of electrical conductivity, comprising:

a) polymeric substrate material physically bonded to an intermediate composition having a complexing or reacting group;

b) transition metal ion complexed or reacted with said complexing or reacting group of said intermediate composition; and c) anion moiety combined with said transition metal ion;

wherein said intermediate composition is selected from the group consisting of an acid dyestuff, a disperse dyestuff, a cationic dyestuff, a reactive dyestuff, an anionic dyestuff, and a direct dyestuff.

2. The polymeric substrate material of claim 1, wherein said polymeric substrate material is selected from the group consisting of polyolefins, polyvinyls, polyesters, polyethers, polycarbonates, polyamides, acetates, triacetates, polyaramids, polyimids, cellulose, and keratin;

wherein said transition metal ion is a coinage metal ion; and wherein said anion moiety is sulphide ion or iodide ion.

3. The polymeric substrate material of claim 1, wherein said intermediate composition is selected from the group consisting of azo dye, oxazine dye, styryl dye, and anthraquinone dye; and wherein said coinage metal is selected from the group consisting of copper, silver, ruthenium, rhodium, palladium, osmium, iradium, and platinum.

* * * * *